United States Patent [19]

Sass et al.

[11] 4,040,692

[45] Aug. 9, 1977

[54] CONVERTIBLE MULTIPURPOSE TABLE

[76] Inventors: Daniel B. Sass, 27 High St., Alfred, N.Y. 14802; William A. Earl, 1571 Waterweels Road; Joseph Fasano, R.D., both of Alfred Station, N.Y. 14803

[21] Appl. No.: 584,462

[22] Filed: June 6, 1975

[51] Int. Cl.[2] ..... A47B 27/00

[52] U.S. Cl. ..... 312/194; 312/231; 108/3

[58] Field of Search ..... 312/194, 198, 313, 239, 312/281, 213, 196, 282, 209; D6/156, 167; 108/3, 4, 59, 64

[56] References Cited

U.S. PATENT DOCUMENTS

| | | | |
|---|---|---|---|
| 168,732 | 10/1875 | Everitt | 312/281 |
| 317,288 | 5/1885 | Bowman | 108/3 |
| 1,303,280 | 5/1919 | Fliedner | 312/313 X |
| 1,492,828 | 4/1924 | Cook | 312/282 X |
| 1,829,288 | 10/1931 | May | 108/4 |
| 1,886,766 | 11/1932 | Ulrich | 312/198 X |
| 2,223,405 | 12/1940 | Cain | 312/213 |
| 2,694,614 | 11/1954 | Dent | 312/281 |
| 2,928,703 | 3/1960 | Paulsen | 312/282 X |
| 3,095,833 | 7/1963 | Peter | 108/3 |
| 3,244,465 | 4/1966 | Ulrich, Jr. et al. | 312/231 |
| 3,290,105 | 12/1966 | Nall | 312/209 |
| 3,630,588 | 12/1971 | Baker | 312/231 |
| 3,696,760 | 10/1972 | Riley | 312/239 X |
| D. 167,145 | 7/1952 | Harmon | D6/156 |

FOREIGN PATENT DOCUMENTS

| | | | |
|---|---|---|---|
| 526,213 | 5/1955 | Italy | 312/313 |

*Primary Examiner*—James T. McCall
*Attorney, Agent, or Firm*—Joseph A. Finlayson, Jr.

[57] ABSTRACT

A multiple purpose unitary work table for student study having inclinable surface portions for efficiently accommodating a plurality of individuals or alternatively providing a relatively large and substantially smooth work surface. Each of the surface portions may provide a horizontal study table or, alternatively, an inclined table surface for drawing or other laboratory purposes according to the desire of the user.

4 Claims, 9 Drawing Figures

CONVERTIBLE MULTIPURPOSE TABLE

CROSS REFERENCES TO RELATED APPLICATIONS

This application is related to Ser. No. 363,627 filed May 24, 1973, now abandoned.

BACKGROUND OF INVENTION

1. Field of Invention

This invention is related to the construction of a multiple purpose unitary work table for accomodating a plurality of individuals, and more particularly, to a convertible laboratory work table specifically suited for efficient classroom use in the study of the sciences, such as geography, drafting, earth science, or for study carrels wherein the table may be converted from a structure having one large surface area to a structure having a plurality of individual inclined work surface areas.

2. Prior Art

Multiple purpose convertible work tables having a single inclinable surface portion, such as disclosed by U.S. Pat. No. 1,303,280 issued to Fliedner, have been in use as a drawing table, laboratory table, or other educational purposes. However, a plurality of table units of the aforementioned type may not necessarily be the most economical and efficient means to accomodate a corresponding number of artisans or students for a given work area or classroom size. Additionally, a classroom equiped with such table units may not be conductive to the kind of group study which would require that several students work closely together either with separately inclined table surfaces or on one relatively large and smooth work surface.

Other attempts have been made to provide a convertible work table having the advantages of accomodating one individual or a group of individuals working separately or collaboratively, however, the results of those attempts seem to have failed to account for economy, efficiency in space required for a plurality of individuals, convenience of convertibility from a horizontal work surface to an incline work surface, and adaptability to group study when the occasion requires.

Other patents which are similar to, but significantly different from applicant's invention, include U.S. Pat. No. 3,696,760 issued to Riley, which discloses a modular learning table for accomodating a plurality of students with fixed inclined adjustable level surface areas in a single table unit and U.S. Pat. No. 1,886,766 issued to Ulrich, which discloses a desk construction which is particularly adapted to be disposed end to end or back to back to form a multiple unit assembly.

SUMMARY OF INVENTION

The invention disclosed herein defines a unitary convertible multiple purpose work table structure for accomodating a plurality of individuals, either individually for independent study or jointly for simultaneous group collaboration, for efficient and convenient use by students or artisans in a classroom or given work area. The work table has a unique table top assembly which is equiped with a plurality of inclinable surface portions for several individuals. The inclinable surface portion may be selectively raised to an incline position or lowered to a horizontal position according to the desire of the individual artisan or student. The inclined surface may be adapted to have an adjustable incline to suit a particular need for the occasion or the desire of the user.

When all of the inclinable surface portions are disposed in a horizontal position, the unitary work table will provide a relatively large and substantially smooth work surface area for various other purposes, such as the anaylsis of large drawings or maps. The provision of the large work surface is particularly advantageous for study or work in concert.

The structural design of the unitary table allows for more efficient use of a given work area or classroom size as provided by the disposition of the individual work stations on both sides of the work table.

Moreover, the invention provides for the allocation of separate enclosable compartments for each of the work stations in its preferred embodiment. These compartments are suitable for the convenient storage of laboratory or drawing equipment which may be employed therewith.

In accordance with the foregoing, a primary purpose of the invention is to provide a unitary convertible work table having a plurality of inclinable surface portions which can conveniently accomodate the greatest number of persons in the least possible space.

A further object and important attribute of this invention is to provide a unitary convertible table which may provide separate inclined surface tables for a plurality of individuals or alternatively provide a single large and relatively smooth work surface suitable for the needs of the occasion.

Another object of the invention is to provide a unitary convertible work table conveniently suitable for multiple uses.

Another object of the invention is to provide a work table for the simultaneous convenient use by several artisans or students either separately or jointly.

Another object of the invention is to provide a unitary work table having all of the aforementioned attributes, and additionally, separate enclosable compartments suitable for storage of laboratory equipment or other utensils for each work station.

Other objects of the invention will become readily apparent upon consideration of the following detailed description and drawings.

DETAILED DESCRIPTION OF INVENTION

Figure 1:
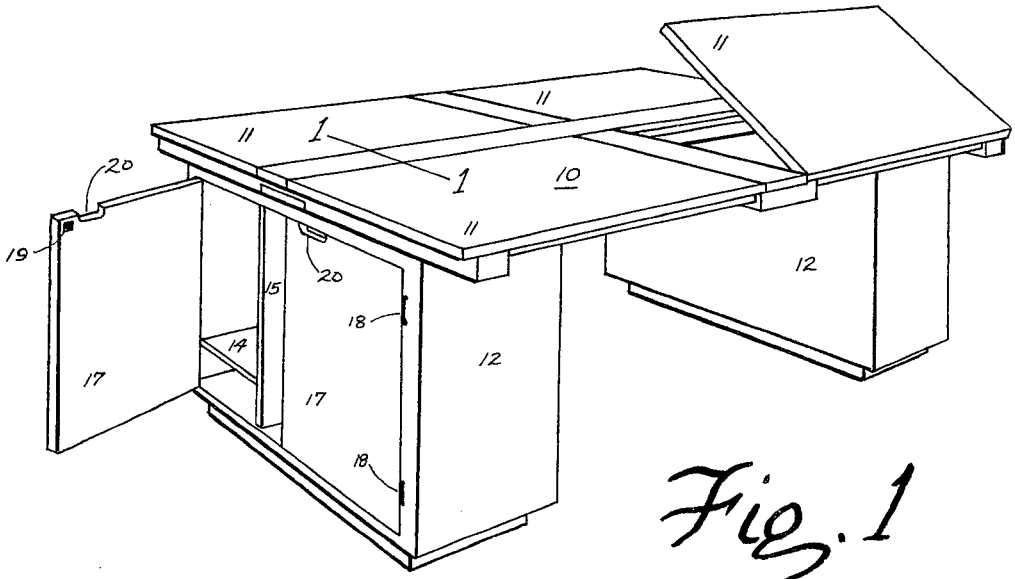
FIG. 1 shows a perspective view of the work table of the present invention.

In the preferred embodiment of the invention, FIG. 1, shows a unitary convertible work table having four surface portions whereby each surface portion is inclinable according to the desire of the individuals at the various work stations. Even though a work table having four surface portions is shown and described in the description, it is not the intention of applicants to limit the invention to what is shown or described, but to include a work table of the type shown having any number of inclinable surface portions.

Generally shown in FIG. 1 is the entire table structure having table top assembly 10, inclinable surface portions 11, and support cabinets 12 with multiple compartments defined by cabinet partitions 14 and 15. Cabinets 12 are equiped with hinged doors 17, latch means 19, and handle means 20.

Figure 2:
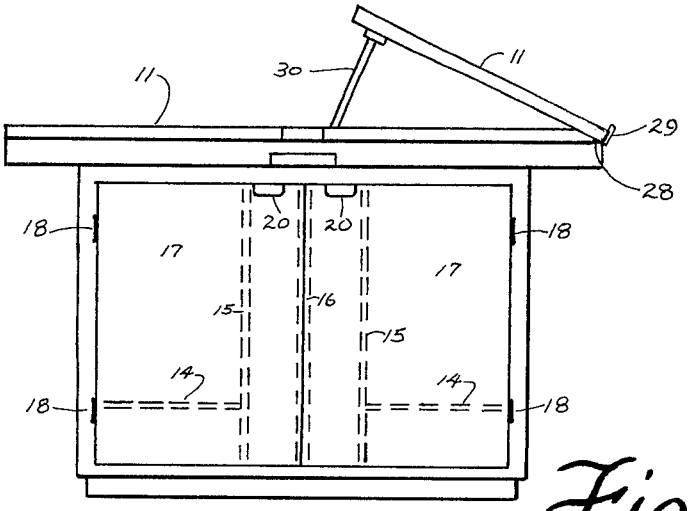
FIG. 2 shows a side view of the work table particularly disclosing an adjustable surface portions and the interior partition in the base support cabinets.

Now, referring to FIG. 2, a side view of the entire work table structure of FIG. 1 is shown. As clearly illustrated in the drawings, surface portion 11 is shown in an inclined position supported therein by support means 30. Support means 30 is adapted to be connected to a portion of the table top assembly 10 and the underside of inclinable surface portion 11. Support means 30 may also be adapted to have a variable length whereby the incline of surface portion 11 may be changed. Also indicated in FIG. 2, is stop ledge 29 which is shown to be connected to only one of the surface portions 11 to allow for retainment of equipment or work utensils on the upper-most surface of surface portion 11. The raised surface portion 11 is also shown with hinge means 28 which connects the surface portion to a support member of table top assembly 10 in a manner whereby the surface portion may be pivotably lowered from a horizontal position or raised to an inclined position. Hinges 18 are shown on doors 17 or cabinets 12 in the side view. Partitions 14, 15, and 16 divide the cabinets 12 into several compartments. Handle means 20 are also shown near the upper extremity of doors 17.

Figure 3:
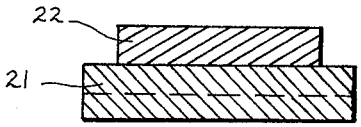
FIG. 3 shows a cross sectional view of a portion of the surface member and support members taken across line 1—1 of FIG. 1.

FIG. 3 shows a portion of the surface member 22 in contact with a portion of support member 21 of the surface top assembly.

Figure 4:
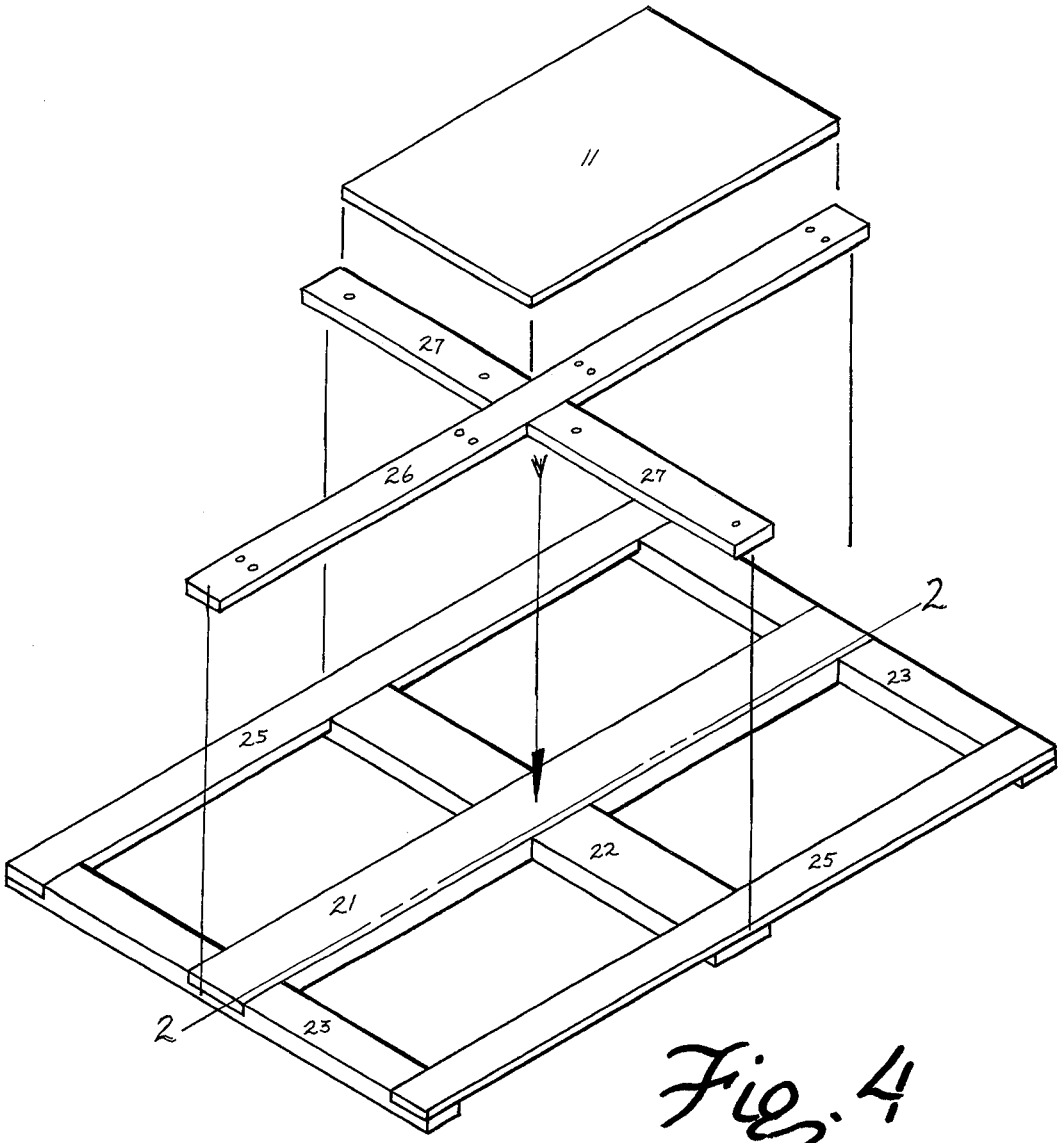
FIG. 4 illustrates a perspective view of a surface portion, surface member, and support member of the table top assembly in spaced-apart relation.
Figure 5:
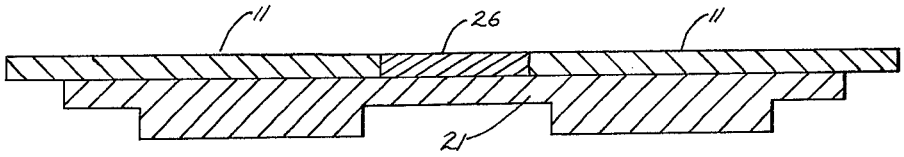
FIG. 5 shows a cross sectional view of the table top assembly in assembled relation taken across line 2—2 of FIG. 4.

Now, referring to FIGS. 4 and 5, the table top assembly 10 is shown in spaced-apart relation and in assembled relation, respectively. In FIG. 4, only one of the surface portions 11 is shown. A surface member is defined by connecting elements 26 and 27 which are of a thickness so as to be flush with the surface portions to form a substantially smooth work surface when all surface portions are lowered to a horizontal position. The support member for supporting the surface portions on hinges is shown in FIG. 4 by connecting elements 21, 22, 23, and 25. The assembly in assembled relation is shown in FIG. 5 wherein elements 11 are the inclinable surface portions and element 26 is a cross section of a portion of the surface member, and element 21 is a cross section of the support member. No hinges or connection means are shown in FIG. 5.

Figure 6:
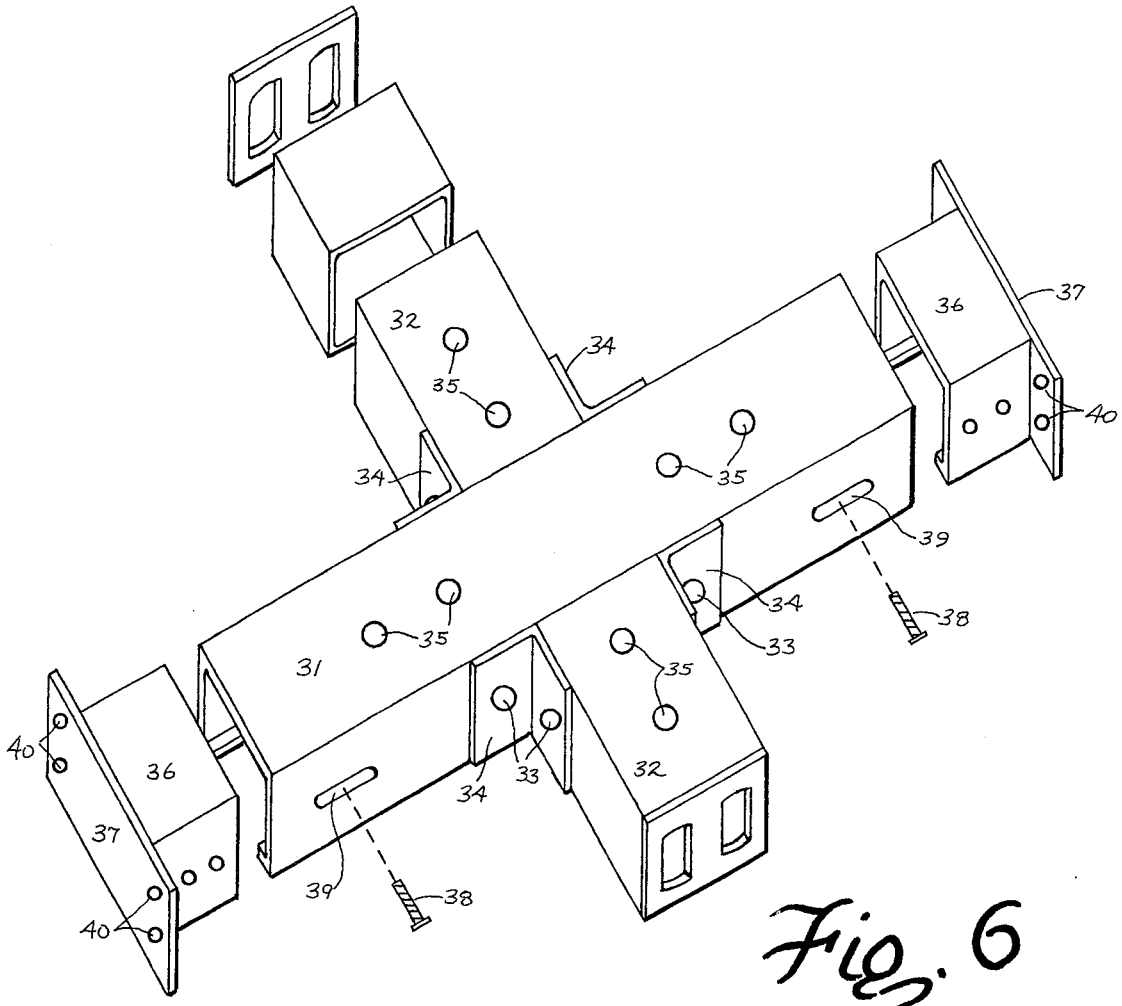
FIG. 6 shows a perspective view, partly in phantom, of a metal base member for connecting the table top assembly to the table support cabinets.
Figure 7:
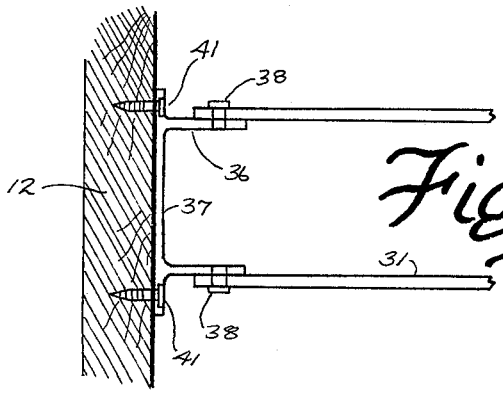
FIG. 7 shows a bracket arrangement of FIG. 6 for attaching the metal base member to the support cabinets.
Figure 8:
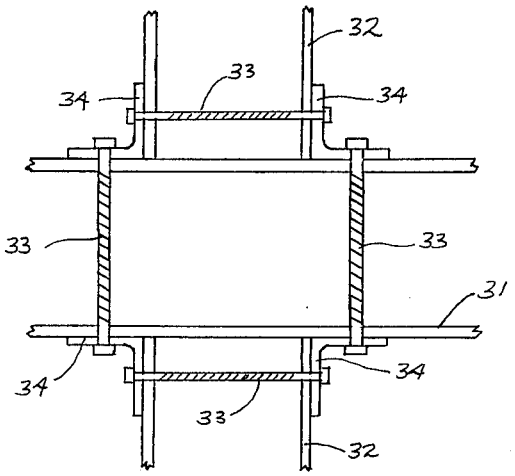
FIG. 8 shows a planar view of the bracket arrangement for attaching the components of the base member.
Figure 9:
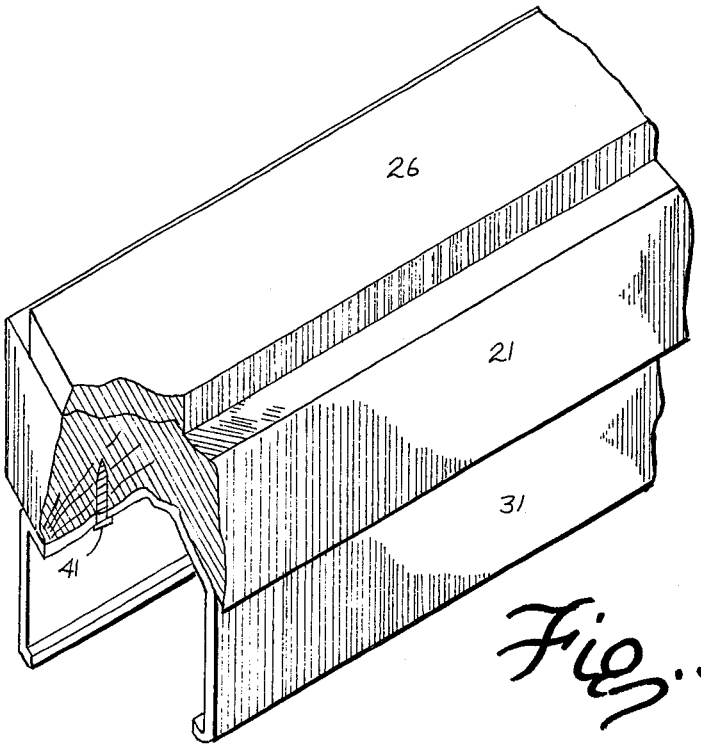
FIG. 9 shows the blown up perspective view of the attachment of the base member to the surface portion support member at one location.

Referring now to FIG. 6, a base member for connecting the support cabinets 12 to the surface top assembly 10 is shown wherein base member element 31 is connected to cross members 32 by brackets 34 having associated therewith, machine screws 33. Brackets 36 having connection plates 37 are adapted to be connected to the walls of the respective support cabinets 12 via connection means 40. Brackets 36 are adapted to be connected to member 31 via adjustable connection means 39 and screws 38 and 40. FIG. 8 shows a planar view of the manner of connecting elements 31 and 32 of the base member. As clearly illustrated, brackets 34, together with machine screws 33, hold the elements of the base member in rigid assembled relation. FIG. 9 shows a wood screw 41 for connecting a portion of base member 31 to a portion of support member 21. Element 26 of surface member assembly is also shown.

In operation, the surface portion 11, which define the individual work surfaces, may be selectively raised to an incline position and held by support means 30 or lowered to a horizontal position according to the desire of the users. All of the surface portions may be lowered so as to provide a relatively large and substantially smooth work surface as the surface member is substantially flush and in the same plane of the surface portions in the horizontal position.

Furthermore, since numerous modifications and changes will readily occur to those skilled in the art, it is not desired to limit the invention to the exact construction and operation shown and described, and accordingly, all suitable modifications and equivalents may be resorted to as falling within the scope of the invention as claimed.

Now therefore, a complete description of the invention having been made, what is claimed is:

1. A multiple purpose unitary convertible work table having inclinable surface portions for separately accomodating a plurality of individuals or alternatively providing a relatively large and substantially smooth work surface comprising:

a table top assembly having opposed sides and opposed ends, said table top assembly consisting of a support member having corresponding opposed sides and ends for supporting all of said surface portions in a horizontal position in a single plane, said surface portions being generally disposed lengthwise along each of said opposed sides and on top of said support member in parallel planar relation and being adapted to be selectively moved from a horizontal position to an incline position, hinge means connecting the outermost lengthwise edge of each surface portion to one of the opposed sides of said support member for allowing each of said surface portions to be pivotally moved from a horizontal position to an incline position, incline support means associated with each of said surface portions for holding said surface portion in an incline position when moved thereto, and a surface member connected to said support member and fitting between and immediately adjacent said surface portions when said surface portions are disposed in said horizontal position to form a substantially smooth work surface;

table support means for supporting said table top assembly in a substantially horizontal position; and a base member having connecting means for connecting said table top assembly to said table support means.

2. The invention of claim 1 wherein said table support means comprise two cabinets having multiple compartments wherein said table top assembly is supported by one of said cabinets disposed at each of said opposed ends.

3. The invention of claim 1 wherein a stop ledge is disposed on the outermost edge of each of said surface portions.

4. The invention of claim 1 wherein said table top assembly has four inclinable surface portions wherein two of said surface portions are disposed on each of said opposed sides of the support member.

* * * * *